US009859639B2

(12) United States Patent
Tagami et al.

(10) Patent No.: US 9,859,639 B2
(45) Date of Patent: Jan. 2, 2018

(54) CONNECTOR

(71) Applicant: Molex, LLC, Lisle, IL (US)

(72) Inventors: Hideyo Tagami, Yamato (JP); Naoya Inoue, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/217,598

(22) Filed: Jul. 22, 2016

(65) Prior Publication Data

US 2017/0062962 A1 Mar. 2, 2017

(30) Foreign Application Priority Data

Aug. 24, 2015 (JP) ..... 2015-165248

(51) Int. Cl.
*H01R 12/88* (2011.01)

(52) U.S. Cl.
CPC ..... *H01R 12/88* (2013.01)

(58) Field of Classification Search
CPC ..... H01R 12/88
USPC ..... 439/329
See application file for complete search history.

(56) References Cited

U.S. PATENT DOCUMENTS 7,530,831 B2 * 5/2009 Nishimatsu ..... H01R 12/79 439/260
8,651,885 B2 * 2/2014 Ashibu ..... H01R 12/774 439/328
8,662,916 B2 * 3/2014 Ashibu ..... H01R 12/88 439/260
8,986,031 B2 * 3/2015 Matoba ..... H01R 13/62 439/267
9,252,516 B2 * 2/2016 Ashibu ..... H01R 12/79
9,531,096 B2 * 12/2016 Chen ..... H01R 12/88
2007/0066127 A1 * 3/2007 Inoue ..... H01R 12/79 439/495
2007/0173106 A1 * 7/2007 Wei ..... H01R 12/79 439/495
2011/0244709 A1 * 10/2011 Ashibu ..... H01R 12/774 439/372
2012/0100736 A1 * 4/2012 Ashibu ..... H01R 12/88 439/260

(Continued)

FOREIGN PATENT DOCUMENTS

JP 2002-246086 A 8/2002
JP 2006-073319 A 3/2006

(Continued)

*Primary Examiner* — Alexander Gilman
(74) *Attorney, Agent, or Firm* — James A. O'Malley

(57) ABSTRACT

A connector is provided which has a housing, an actuator, and a plurality of primary terminals. The housing has an insertion passage for insertion of a flat cable from the front end. The actuator has a pressure-applying portion, and an engaging portion pushed upwards by the end portion of the flat cable as the flat cable is being inserted. Each of the primary terminals has an upper beam positioned above the insertion passage. Each upper beam has a contact portion for making contact with the flat cable, and a receiving portion positioned in front of the contact portion and arranged above the pressure-applying portion. The receiving portion makes contact with and is pushed upward by the pressure-applying portion when the engaging portion is pushed upward by the end portion of the flat cable.

15 Claims, 9 Drawing Sheets

(56) References Cited

U.S. PATENT DOCUMENTS

| | | | | |
|---|---|---|---|---|
| 2015/0056840 | A1* | 2/2015 | Ohyama | H01R 12/774<br>439/350 |
| 2015/0118909 | A1* | 4/2015 | Yokoo | H01R 12/775<br>439/607.55 |

FOREIGN PATENT DOCUMENTS

| | | | |
|---|---|---|---|
| JP | 2010-153209 | A | 7/2010 |
| JP | 2013-211140 | A | 10/2013 |

* cited by examiner

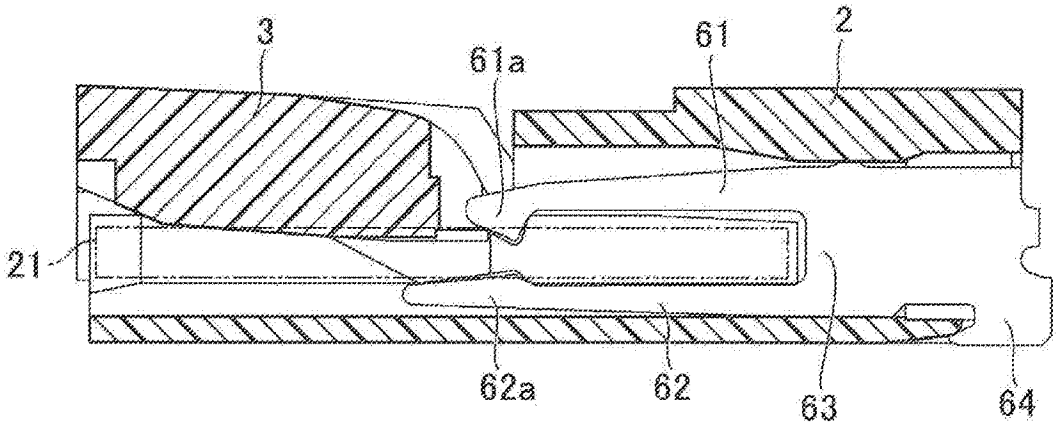
FIG. 6
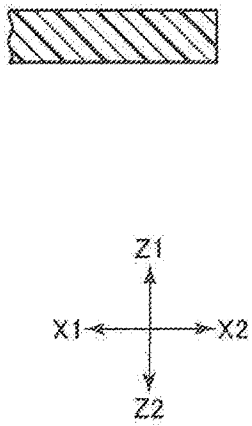

CONNECTOR

RELATED APPLICATIONS

This application claims priority to Japanese Application No. 2015-165248, filed Aug. 24, 2015, which is incorporated herein by reference in its entirety.

TECHNICAL FIELD

The present disclosure relates to a connector.

BACKGROUND ART

Connectors for flat cables are widely used.

In Patent Document 1, the actuator is held in the closed position by a plate spring, and a flat cable is inserted into the connector against the spring action of the plate spring. (In Patent Document 1, the actuator and the plate spring are referred to, respectively, as the 'lock member 7' and the 'pressing member 21'. In Patent Document 2, the actuator and the plate spring are referred to, respectively, as the 'actuator 11' and the 'elastic closing member 11d'.) In the connectors disclosed in Patent Document 1 and Patent Document 2, an engaging portion on the actuator engages a hole formed in a side portion of a flat cable when the flat cable has been inserted into the connector. This keeps the flat cable from becoming detached from the connector.

In Patent Document 2, each terminal has a movable beam and a fixed beam facing each other in the vertical direction. These two beams clamp the flat cable using the elastic force of each terminal to establish an electrical connection with the flat cable. In the actuator, a pressure-applying cam is arranged between the two beams. When a flat cable is inserted into the connector, the end portion of the actuator pushes the actuator upward and the pressure-applying cam portion pushes the movable beams upwards. In this way, the flat cable can be inserted into the connector without the flat cable coming into contact with the movable beams.

Patent Document 1: Laid-Open Patent Publication No. 2013-251210

Patent Document 2: Laid-Open Patent Publication No. 2010-153209

SUMMARY

In connectors enabling a flat cable to be inserted without requiring operation of the actuator, less force required to insert the flat cable is desired. However, for example, in the case of the connector disclosed in Patent Document 2, the pressure-applying cam portion pushes up the central portion of the movable beams at a position to the rear of where the flat cable makes contact with the movable beams. As a result, more force tends to be required to insert the flat cable.

The present disclosure provides a connector enabling insertion of a flat cable without requiring operation of an actuator and enabling a reduction in force required to insert a flat cable.

The present disclosure is a connector comprising: a housing having an insertion passage for insertion of a flat cable from the front end, an actuator, and a plurality of primary terminals arranged inside the housing in the transverse direction; the actuator having a pressure-applying portion, and an engaging portion making contact with an end portion of the flat cable and being pushed upwards by the end portion of the flat cable as the flat cable is being inserted; each of the primary terminals having an upper beam positioned above the insertion passage; and each upper beam having a contact portion for making contact with the flat cable, and a receiving portion positioned in front of the contact portion and arranged above the pressure-applying portion, the receiving portion making contact with and being pushed upward by the pressure-applying portion when the engaging portion is pushed upward by the end portion of the flat cable.

In another embodiment of the present disclosure, the pressure-applying portion of the actuator moves downward away from the receiving portion of the upper beams when the flat cable has been inserted.

In another embodiment of the present disclosure, the receiving portion of the upper beams and the pressure-applying portion of the actuator are positioned in front of the position at which the end portion of the flat cable makes contact with the engaging portion of the actuator.

In another embodiment of the present disclosure, the engaging portion is fitted into a hole or notch in the flat cable when the flat cable has been inserted.

In another embodiment of the present disclosure, the actuator is able to rotate between a first orientation in which the engaging portion is positioned in the middle of the insertion passage and a second orientation in which the engaging portion stands upright relative to the housing, the pressure-applying portion of the actuator pushing the receiving portion of each upper beam upwards against the elastic force of a primary terminal when the actuator is in the second orientation.

In another embodiment of the present disclosure, the actuator has a stopped portion positioned at least to the left or to the right of the plurality of primary terminals, a stopping portion being provided in front of the stopped portion of the actuator to restrict forward movement of the stopped portion.

In another embodiment of the present disclosure, the actuator is able to rotate around the pressure-applying portion between a first orientation in which the engaging portion is positioned in the middle of the insertion passage and a second orientation in which the engaging portion is retracted upwards from the insertion passage.

In another embodiment of the present disclosure, the stopped portion of the actuator comes into contact with the stopping portion before the pressure-applying portion of the actuator comes into contact with the receiving portions of the upper beams when the actuator is moving forward.

In another embodiment of the present disclosure, the actuator in the first orientation can move in the longitudinal direction between a first position in which the stopped portion of the actuator comes into contact with the stopping portion and a second position in which the stopped portion of the actuator moves away from the stopping portion to the rear allowing rotation from the first orientation to the second orientation.

In another embodiment of the present disclosure, the actuator has a supported portion positioned at least to the left or to the right of the plurality of primary terminals, and the connector has a supporting portion positioned below the supported portion of the actuator for supporting the supported portion, and a spring portion for biasing the supported portion of the actuator towards the supporting portion while the flat cable is being inserted.

In another embodiment of the present disclosure, each of the plurality of primary terminals has a lower beam positioned below the insertion passage, and each upper beam and lower beam clamp the flat cable using the elastic force of the primary terminals.

In another embodiment of the present disclosure, the connector further comprises a plurality of secondary terminals arranged in alternating fashion with the plurality of primary terminals.

BRIEF DESCRIPTION OF THE DRAWINGS

FIG. 6 is a cross-sectional view from VI-VI in FIG. 1.

DETAILED DESCRIPTION OF THE PREFERRED EMBODIMENTS

Figure 1:
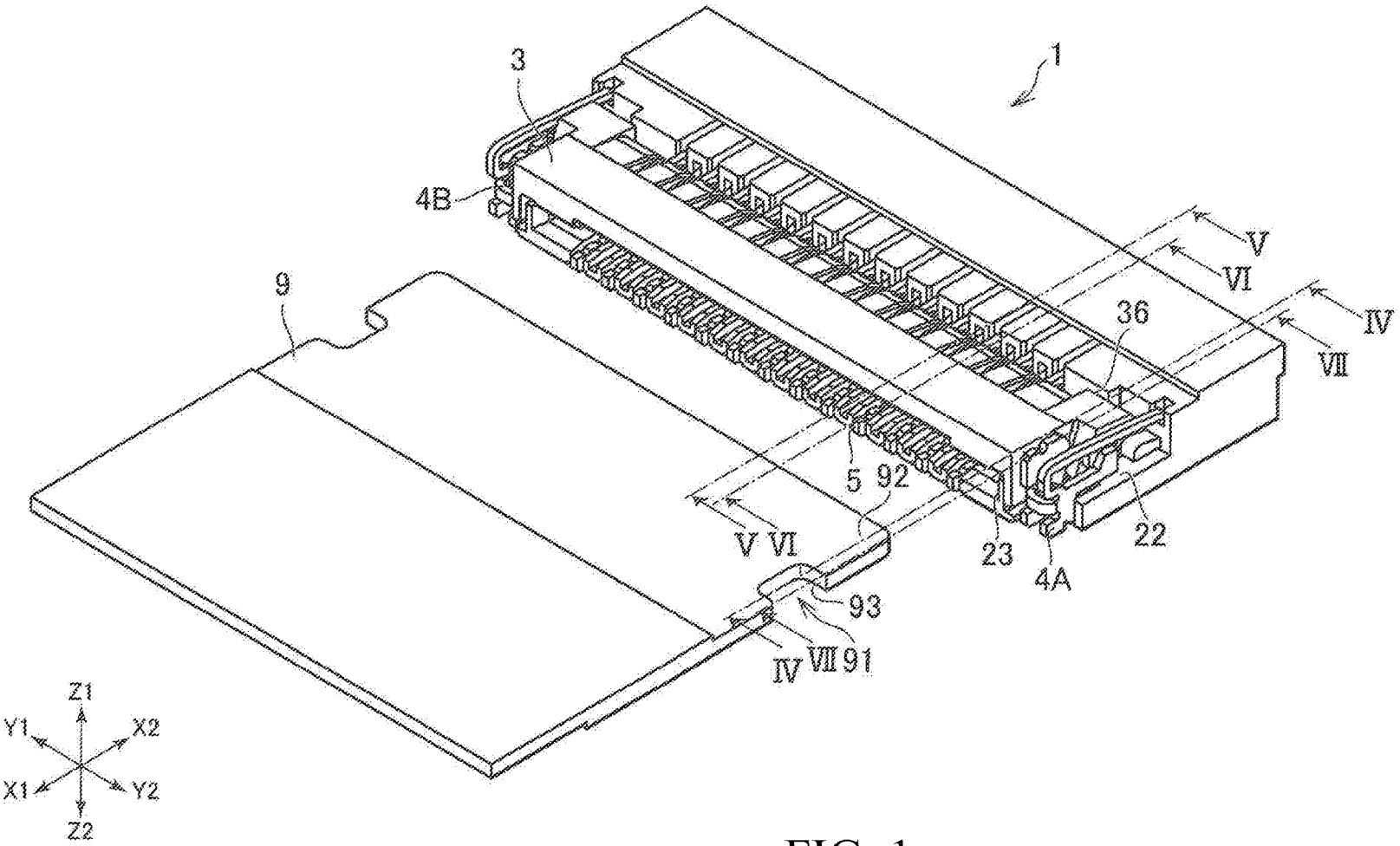
FIG. 1 is a perspective view of a connector and a flat cable in an embodiment of the present disclosure.
Figure 2:
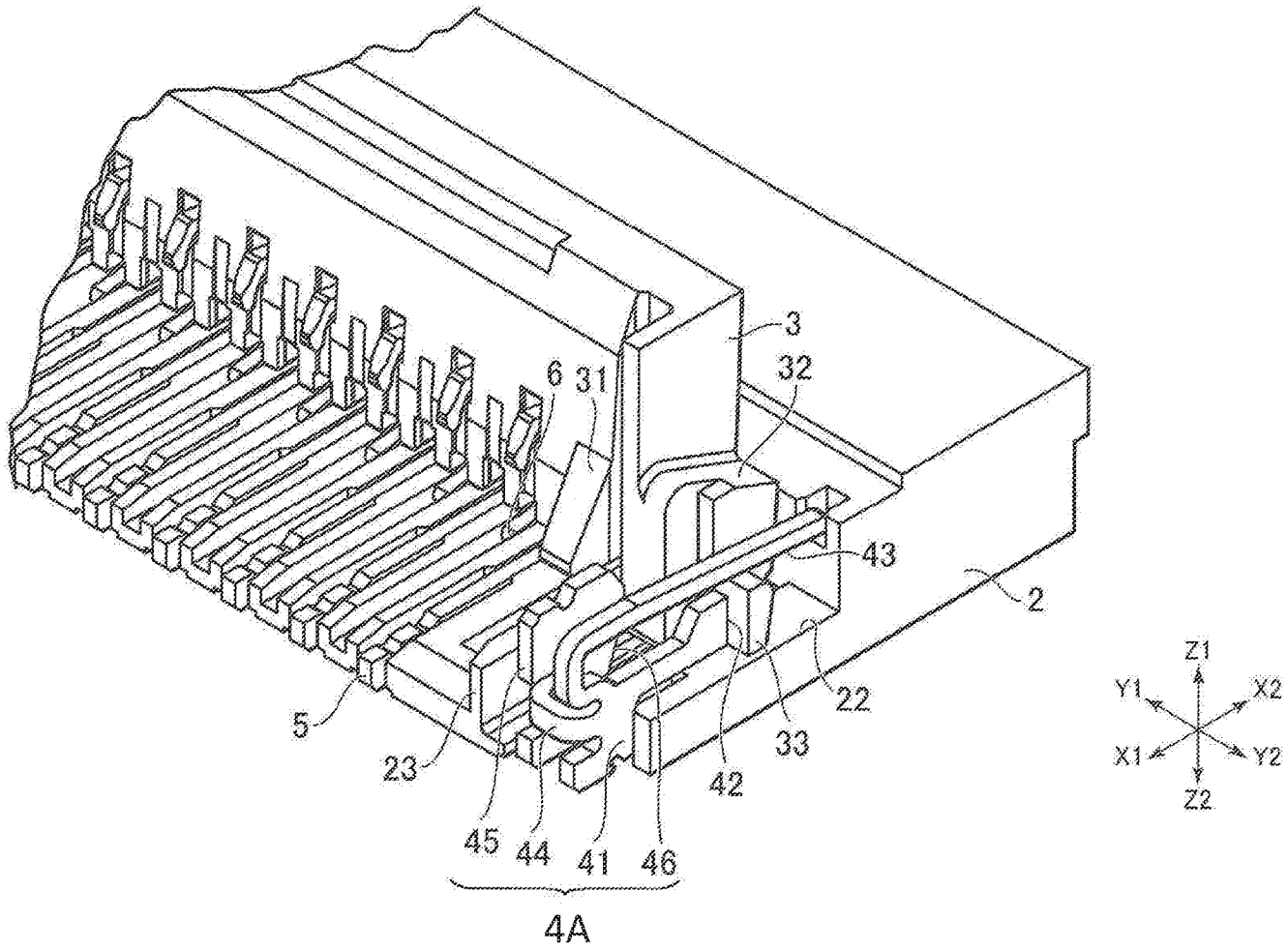
FIG. 2 is an enlarged view of the connector showing an actuator in the second orientation.
Figure 3:
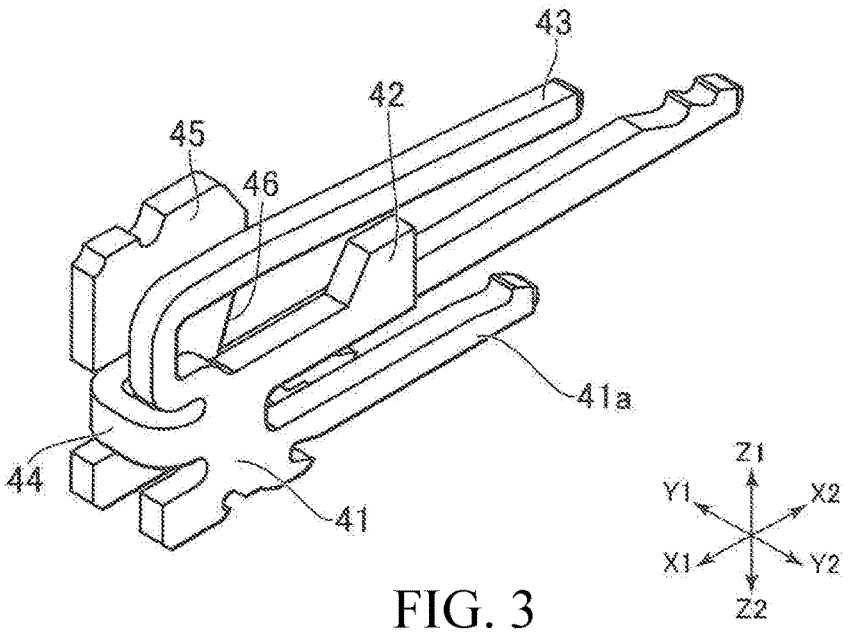
FIG. 3 is a perspective view of a holding member arranged in the connector.

The following is an explanation of a mode of embodying the present disclosure (referred to below as an embodiment) with reference to FIG. 1 through FIG. 8C. FIG. 1 is a perspective view of the connector 1 and the flat cable 9 in an example of an embodiment of the present disclosure (referred to below as the present embodiment). FIG. 2 is an enlarged view of the connector 1. FIG. 3 is a perspective view of the holding member 4A arranged in the connector 1. FIG. 4A through FIG. 4D are cross-sectional views from IV-IV in FIG. 1 showing the positional relationship between the connector 1 and the flat cable 9. FIG. 5A through FIG. 5E are cross-sectional views from V-V in FIG. 1 showing the positional relationship between the connector 1 and the flat cable 9. FIG. 6 is a cross-sectional view of the connector 1 and the flat cable 9 from VI-VI in FIG. 1. FIG. 7A through FIG. 7D are cross-sectional views from VII-VII in FIG. 1 showing the positional relationship between the connector 1 and the flat cable 9. FIG. 8A through FIG. 8C are right side views of FIG. 1 showing the positional relationship between the connector 1 and the flat cable 9.

In each drawing, the directions denoted by X1 and X2 are, respectively, the front and rear directions, the directions denoted by Y1 and Y2 are, respectively, the left and right directions, and the directions denoted by Z1 and Z2 are, respectively, the up and down directions.

Figure 4A:
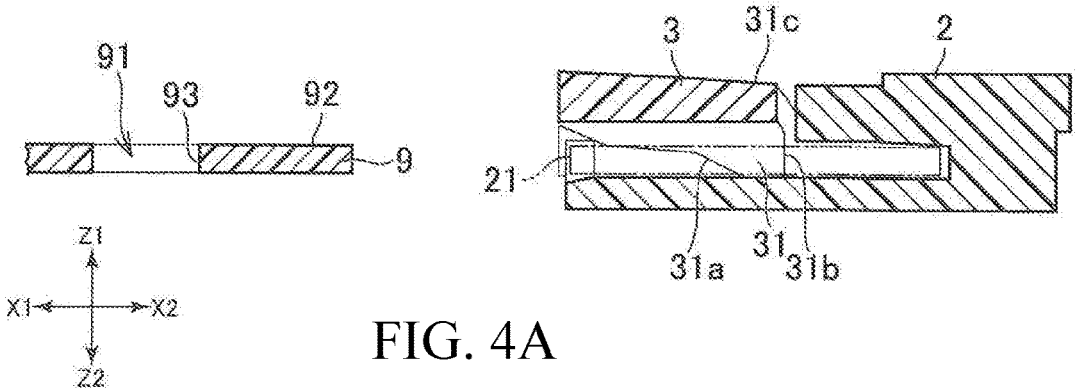
FIG. 4A is a cross-sectional view from IV-IV in FIG. 1.

As shown in FIG. 1 and FIG. 2, the connector 1 in the present embodiment includes a housing 2, an actuator 3, holding members 4A, 4B, primary terminals 5, and secondary terminals 6 (see FIG. 2). As shown in FIG. 2, the primary terminals 5 and the secondary terminals 6 are arranged in the transverse direction inside the housing 2, and each secondary terminal 6 alternates with a primary terminal 5. As shown in FIG. 4A, an insertion passage 21 is provided inside the housing 2 allowing the flat cable 9 to be inserted from the front end.

As shown in FIG. 1 and FIG. 2, the actuator 3 can rotate between a closed orientation in which the forward end or leading end has been pushed down in the forward direction (see FIG. 1) and an open orientation in which the leading end is raised (see FIG. 2). In the present embodiment, the closed orientation corresponds to the 'first orientation' of the present disclosure, and the open orientation corresponds to the 'second orientation' of the present disclosure. As shown in FIG. 2, an engaging portion 31, a stopped portion 32, and a supported portion 33 are formed in the actuator 3 for each primary terminal 5 and secondary terminal 6 on the left and right. Also, supporting portions 22 are formed on both the left end and the right end of the housing 2. Each supporting portion 22 is positioned below a supported portion 33 to support the supported portions 33 from below.

As shown in FIG. 2 and FIG. 3, the holding member 4A includes an outer plate portion 41 and an inner plate portion 45 which are two plate portions extending parallel to each other in the longitudinal and vertical directions. The outer plate portion 41 and the inner plate portion 45 are connected via a bridge portion 44. The holding member 4A includes inserted portions 41*a*, 45*a* extending to the rear from the outer plate portion 41 and the inner plate portion 45. These are inserted into the housing 2 where the leading ends are hooked inside the housing 2 to secure the holding member 4A to the housing 2.

As shown in FIG. 3, the holding member 4A also includes a pressing portion 42 and a spring portion 43 extending to the rear from the outer plate portion 41. A stopping portion 46 is formed in the inner plate portion 45 of the holding member 4A. As explained below, the stopping portion 46 restricts forward movement of the actuator 3.

The holding member 4B is formed symmetrically with respect to holding member 4A and has the same structure as holding member 4A. As shown in FIG. 1, holding member 4A is arranged to the left of the primary terminals 5 and the secondary terminals 6, and holding member 4B is arranged to the right of the primary terminals 5 and the secondary terminals 6.

As shown in FIG. 4A, the insertion passage 21 is provided in the housing 2 which covers the upper surface and the lower surface of the inserted flat cable 9 as well as the side surfaces on the rear end. When the actuator 3 is in the closed orientation, the engaging portion 31 formed in the actuator 3 is positioned in the middle of the insertion passage 21 in the longitudinal direction. The engaging portion 31 has a shape which protrudes downward. More specifically, there is an inclined surface 31*a* and a rear surface 31*b* extending rearward and downward when viewed from the side. Because of the inclined surface 31*a*, the flat cable 9 can be easily inserted. Because the rear surface 31*b* faces the edge 93 of the flat cable 9 described below, the flat cable 9 is kept from becoming detached.

Figure 4B:
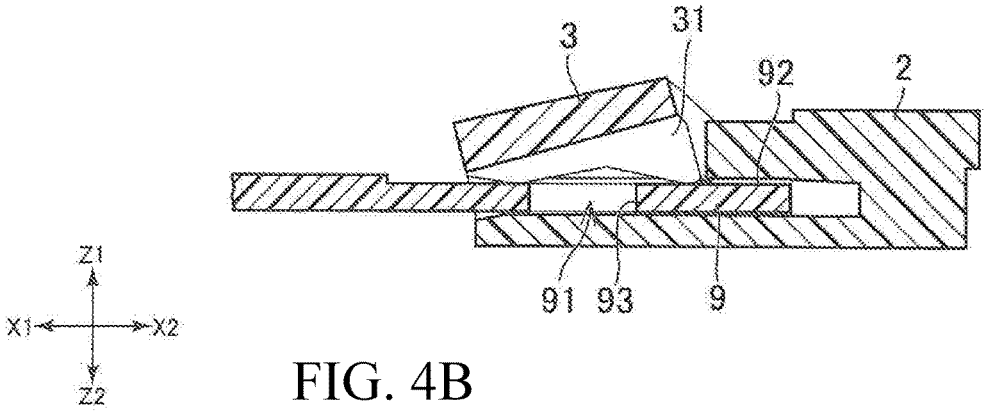
FIG. 4B is the cross-sectional view in FIG. 4A during insertion of the flat cable.

As shown in FIG. 4B, the flat cable 9 is inserted into the insertion passage 21 with the actuator 3 in the closed orientation. As the flat cable 9 is being inserted, the engaging portion 31 comes into contact with the end portion 92 on the rear end and right (or left) side of the flat cable 9 and is pushed upward by the end portion 92. Here, the contact position between the engaging portion 31 and the end portion 92 of the flat cable 9 is to the rear of the contact position between the pressure-applying portion 35 and the receiving portion 51*b* described below (see FIG. 5A and FIG. 5B). As a result, the rear end of the actuator 3 is raised when the engaging portion 31 is pushed upward. The orientation of the actuator 3 when the rear end is raised is referred to as the floating orientation.

Figure 4C:
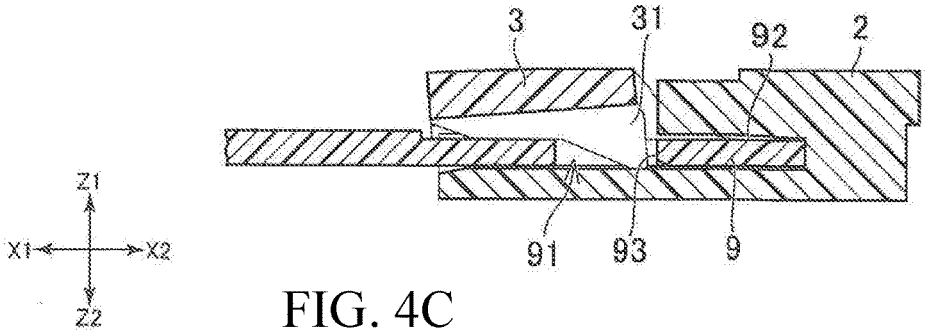
FIG. 4C is the cross-sectional view in FIG. 4A after insertion of the flat cable.

When the flat cable 9 is pushed further to the rear inside the insertion passage 1 as shown in FIG. 4C, the engaging portion 31 is fitted into a notch 91 in the flat cable 9, and the actuator 3 moves from the floating orientation to the closed orientation. Because the outside edge 93 of the notch 91 remains in contact with the engaging portion 31 even when the flat cable 9 is pulled in the forward direction, the flat cable 9 is kept from becoming inadvertently detached. When the actuator 3 is in the closed orientation in the connector 1 of the present embodiment, the operator can insert a flat cable 9 into the connector 1 and lock the leading end of the inserted flat cable 9 inside the connector 1.

Figure 4D:
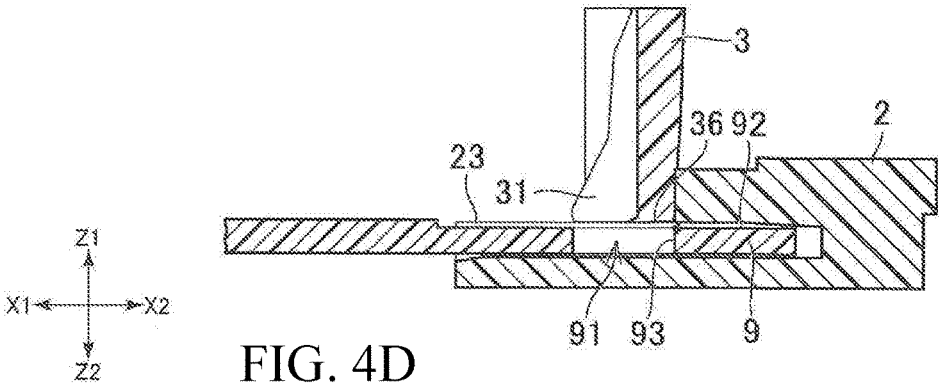
FIG. 4D is the cross-sectional view in FIG. 4A showing the actuator in the second orientation.

Also, when the actuator 3 is in the open orientation shown in FIG. 4D, the engaging portion 31 is positioned above the insertion passage 21. When the engaging portion 31 is retracted and removed from the insertion passage 21, the flat cable 9 is unlocked and the operation can remove the flat cable 9 from the connector 1.

Figure 5A:
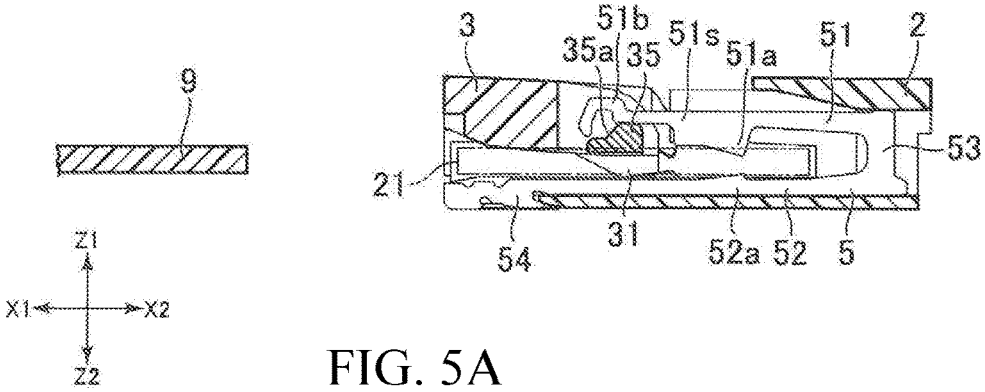
FIG. 5A is a cross-sectional view from V-V in FIG. 1.

As shown in FIG. 5A, the primary terminals 5 are arranged inside the housing 2. Each primary terminal 5 has an upper beam 51 positioned above the insertion passage 21, and a lower beam 52 positioned below the insertion passage 21. Here, a contact point portion 51*s* is formed in the upper beam 51 which protrudes downward from the upper beam and includes a contact portion 51*a* which makes contact with the upper surface of the flat cable 9. A contact portion 52*a* is formed on the lower beam 52 to make contact with the lower surface of the flat cable 9. The upper beam 51 and the lower beam 52 are connected via a support column portion 53 in the rear and the configuration is such that the flat cable 9 is clamped by the elastic force of the primary terminal 5. In other words, as shown in FIG. 5A, the interval between contact portion 51*a* and contact portion 52*a* is narrower than the thickness of the flat cable 9. Because the contact point portion 51*s* extends downward from the upper beam 51, the vertical position of the contact portion 51*a* and the elastic force of the upper beam 51 can be easily adjusted to the dimensions of the inserted flat cable 9.

Each primary terminal 5 is made from a conductive material such as a metal. At least one of contact portion 51*a* and contact portion 51*b* of each primary terminal 5 makes contact with a conductive wire or conductive surface (not shown) on the upper surface or lower surface of the flat cable 9 to establish an electrical connection between the primary terminal 5 and the flat cable 9. A securing portion 54 is formed on the front end of the lower beam 52 to engage the housing 2 and secure the connector 1 to the board (not shown).

Figure 5B:
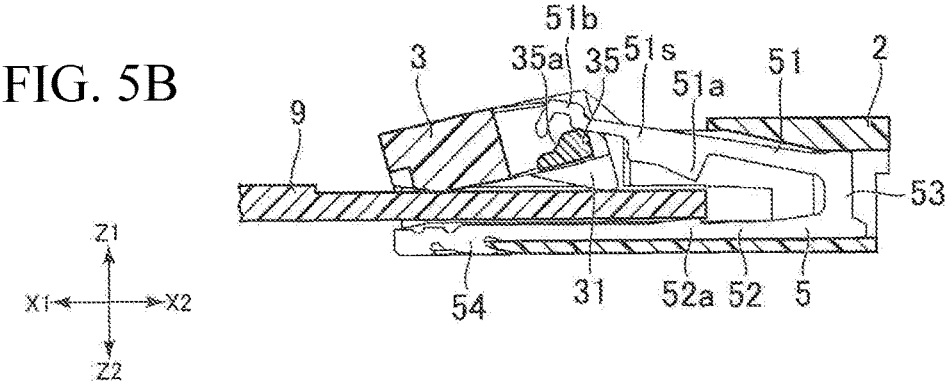
FIG. 5B is the cross-sectional view in FIG. 5A during insertion of the flat cable.

As shown in FIG. 4B and FIG. 5B, the engaging portion 31 formed in the actuator 3 is positioned in the middle of the insertion passage 21 in the longitudinal direction, and comes into contact with and is pushed upward by the end portion 92 of the flat cable 9 in front of the contact portions 51*a* formed in the upper beams 51*a* of the primary terminals 5 when the flat cable 9 is being inserted.

Also, as shown in FIG. 5A and FIG. 5B, a pressure-applying portion 35 is formed in the actuator 3 to push upwards on the upper beams 51 of the primary terminals 5. A hook-shaped receiving portion 51*b* is formed in the upper beam 51 of each primary terminal 5 to receive the pressure from the pressure-applying portion 35. When the engaging portion 31 of the actuator 3 is raised by the end portion 92 of the flat cable 9 (that is, when the actuator 3 moves to the floating orientation), the receiving portion 51*b* of each primary terminal 5 comes into contact with the pressure-applying portion 35 of the actuator 3 and is raised against the elastic force of the primary terminal 5. When the receiving portion 51*b* is raised by the pressure-applying portion 35, the upper beam 51 is lifted with the contact point with the support column portion 53 serving as the fulcrum. Here, the receiving portion 51*b* is positioned in front of the contact portion 51*a*, and the position at which the engaging portion 31 of the actuator 3 comes into contact with the end portion 92 of the flat cable 9 (see FIG. 4B) is positioned to the front of the contact portion 51*a*. Because of the principles of a lever, the force required by the pressure-applying portion 35 to raise the receiving portion 51*b* is less than the force required by the upper surface of the flat cable 9 to raise the contact portion 51*a* in the absence of a pressure-applying portion 35. In the connector 1 of the present embodiment, when a flat cable 9 is inserted, the pressure-applying portion 35 raises the receiving portion 51*b* formed in each upper beam 51. As a result, the force acting on the flat cable 9 from the contact portions 51*a* formed in the upper beams 51 can be reduced. In other words, the force required to insert the flat cable 9 can be reduced.

Also, when the actuator 3 is in the floating orientation as shown in FIG. 4B and FIG. 5B, the receiving portion 51*b* formed in the upper beam 51 of the primary terminals 51 and the pressure-applying portion 35 formed in the actuator 3 are both positioned in front of the position at which the end portion 92 of the flat cable 9 makes contact with the engaging portion 31 of the actuator 3. Here, because the position at which the engaging portion 31 and the end portion 92 make contact is to the rear of the position at which the receiving portion 51*b* and the pressure-applying portion 35 make contact, the actuator 3 is pushed up to the floating orientation at the rear when the flat cable 9 is being inserted. In other words, moment acting on the actuator 3 can be prevented in the direction of the open orientation.

When the actuator 3 is in the floating orientation and the upper beams 51 of the primary terminals 5 have been raised, the contact portions 51*a* formed in the upper beams 51 may or may not make contact with the flat cable 9. When the connector has several terminals, that is, when the connector is a so-called multi-terminal connector, the actuator 3 is raised via the engaging portion 31 provided near the transverse end, and the central portion is bent downward in the transverse direction. As a result, only the contact portions 51*a* of the primary terminals 5 near this portion may make contact with the flat cable 9. Because the primary terminals 5 are raised when the actuator 3 is in the floating orientation, the resistance force can be reduced when the flat cable 9 is being inserted into the connector.

Figure 5C:
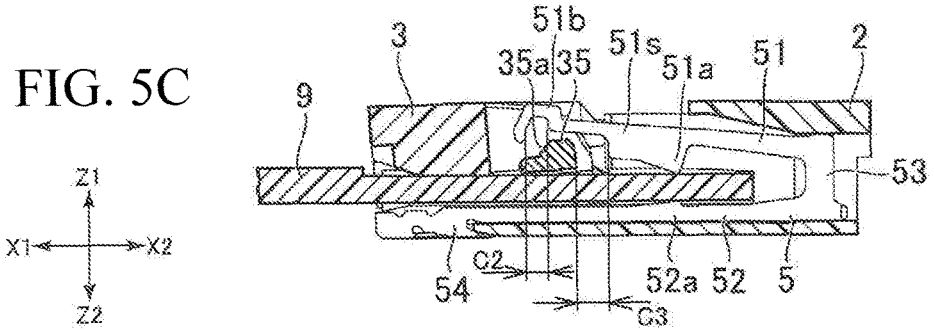
FIG. 5C is the cross-sectional view in FIG. 5A after insertion of the flat cable.

Also, as shown in FIG. 5C, when the flat cable 9 is inserted into the insertion passage 21, the engaging portion 31 on the actuator 3 is fitted into a notch 91 in the flat cable 9 and the actuator 3 is moved to the closed orientation. When the flat cable 9 has been inserted, the contact portions 51*a*, 52*a* formed in the upper beams 51 and the lower beams 52 are positioned inside the insertion passage 21, and the elastic force of the primary terminals 5 presses down on the flat cable 9. Here, when the flat cable 9 has been inserted, the pressure-applying portion 35 of the actuator 3 moves downward away from the receiving portions 51*b* of the upper beams 51. As a result, when the flat cable 9 has been inserted, pressure is maintained between the upper surface of the flat cable 9 and the contact portions 51*a* formed in the upper beams 51. Clearance C3 is provided in the longitudinal direction between the pressure-applying portion 35 and the front edge of the contact point portion 51*s* of the contact portions 51*a*. In this way, the pressure-applying portion 35 is kept from becoming caught on the contact point portions 51*s* and the upper beams 51, and interfering with the actuator 3 in the closed orientation.

As shown in FIG. 6, secondary terminals 6 are arranged inside the housing 2. As in the case of the primary terminals 5, the secondary terminals 6 have an upper beam 61 and a lower beam 62, and the protruding contact portions 61*a*, 62*a* on the leading ends make contact with the flat cable 9. In the secondary terminals 6, a securing portion 64 is also formed to secure the connector 1 to a board (not shown). Unlike the primary terminals 5, the securing portion 64 in the secondary terminals 64 is formed on the rear end of the secondary terminals 6. Also, the upper beams 61 and the lower beams 62 are connected in the rear via support column portions 63 and are configured so that the flat cable 9 is clamped by the elastic force of the secondary terminals 6.

Figure 7A:
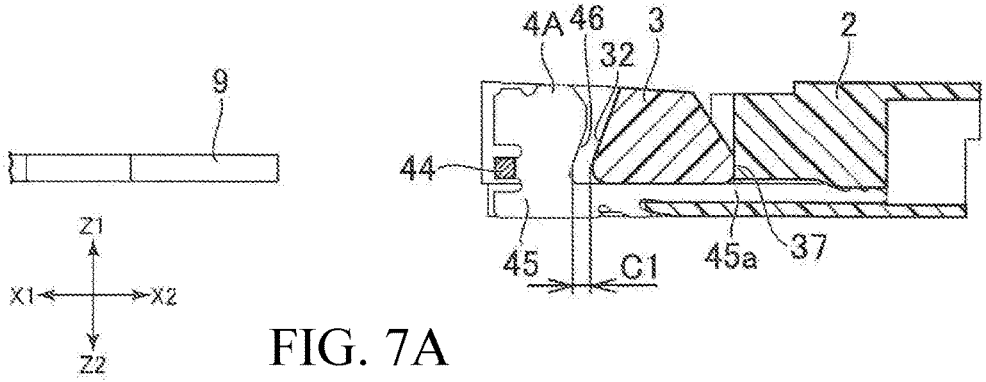
FIG. 7A is a cross-sectional view from VII-VII in FIG. 1.
Figure 8A:
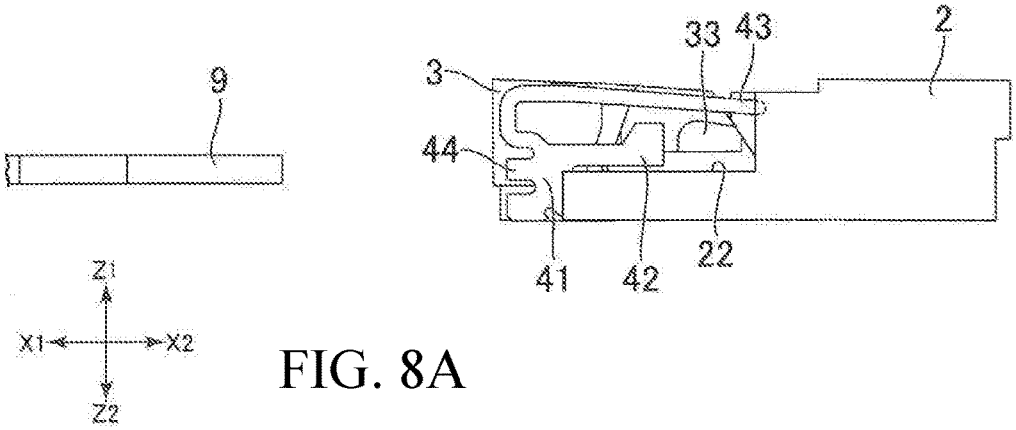
FIG. 8A is a right side view of FIG. 1 before insertion of the flat cable.
Figure 8B:
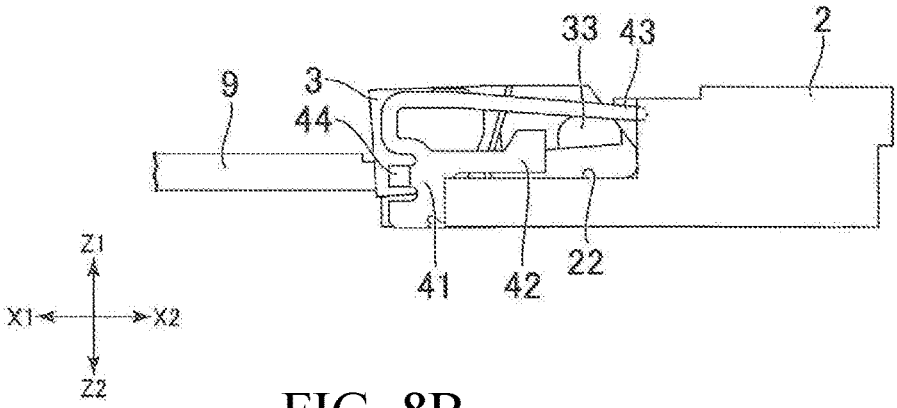
FIG. 8B is the right side view in FIG. 8A after insertion of the flat cable.
Figure 8C:
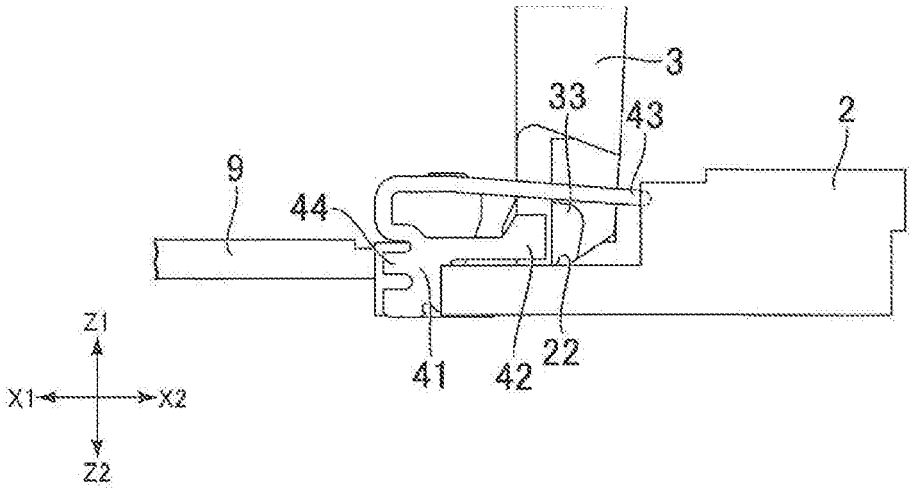
FIG. 8C is the right side view in FIG. 8A showing the actuator in the second orientation.

As shown in FIG. 7A, the holding member 4A is arranged near the left end of the housing 2. The inner plate portion 45 of the holding member 4A includes an inserted portion 45*a* inserted into the housing 2 and a stopping portion 46 including an inclined surface extending upward and to the rear on an incline from near the mounted base of the inserted portion 45*a*. The stopped portion 32 of the actuator 3 also includes an inclined surface extending upward and to the rear on an incline. The stopping portion 46 is arranged in front of the stopped portion 32 of the actuator 3.

Figure 7B:
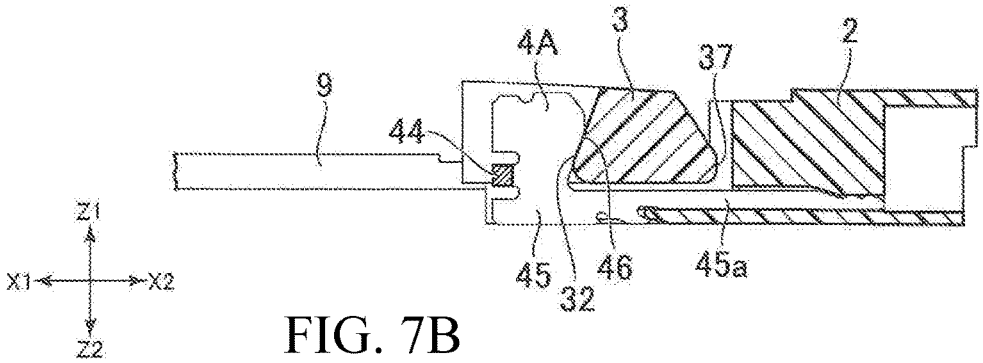
FIG. 7B is the cross-sectional view in FIG. 7A after insertion of the flat cable.
Figure 7C:
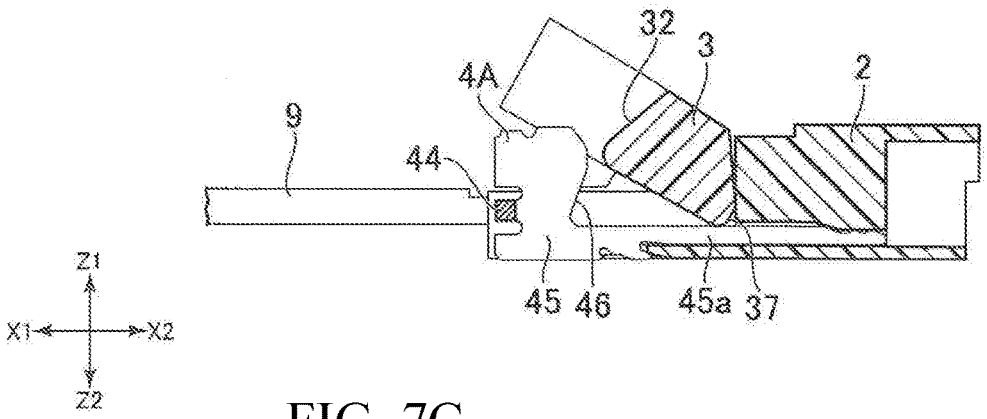
FIG. 7C is the cross-sectional view in FIG. 7A showing the positional relationship between the connector and the flat cable.

As shown in FIG. 7A and FIG. 7B, when a flat cable 9 inserted in the insertion passage 21 is pulled towards the front, the edge 93 formed in the notch 91 of the flat cable 9 pushes against the rear end of the engaging portion 31 of the actuator 3 (see FIG. 4C) and the actuator 3 moves forward. Here, when the rear end of the engaging portion 31 of the actuator 3 sustains the force from the flat cable 9, moment acts on the actuator 3 in the direction of the open orientation. However, the stopped portion 32 of the actuator 3 comes into contact with the stopping portion 46 formed in the holding member 4A, and movement towards the front and the open orientation is restricted by the actuator 3 and the stopped portion 32. When movement of the actuator 3 is restricted in the forward direction, the actuator 3 is kept from becoming detached.

More specifically, when the actuator 3 is in the closed orientation, the actuator 3 can move in the longitudinal direction between the position at which the stopped portion 32 comes into contact with the stopping portion 46 (see FIG. 5D and FIG. 7B) and a position at which the stopped portion 32 has moved away from the stopping portion 46 to the rear (see FIG. 5C and FIG. 7A). Here, when the actuator 3 is arranged in the contact position, the inclined surface in the stopping portion 46 comes into contact with the inclined surface in the stopped portion 32, and the stopped portion 32 is pushed towards the floating orientation. This keeps the actuator 3 from rotating from the closed orientation to the open orientation. Because the pressure applied to the stopped portion 32 is released when the actuator 3 is arranged in the separate position, the actuator 3 is able to rotate towards the open orientation. In other words, the operator is prevented from inadvertently opening the actuator 3 but the operation can rotate the actuator 3 towards the open orientation when the actuator 3 is pushed to the rear (see FIG. 7C). The stopping portion 46 and the stopped portion 32 do not have to have inclined surfaces. Instead, the stopping portion 46 and the stopped portion 32 may have a tiered surface.

Figure 5D:
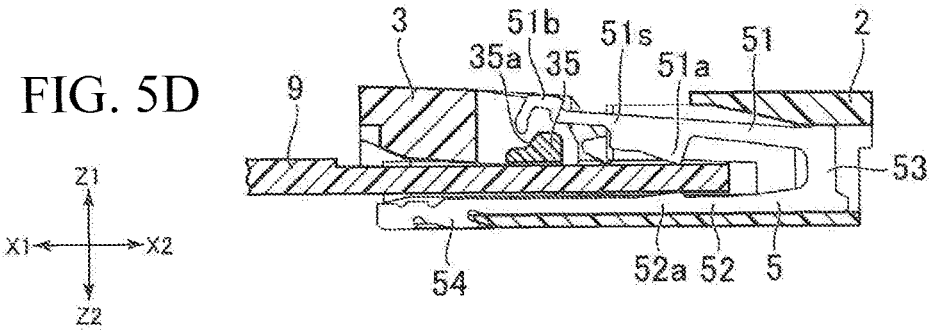
FIG. 5D is the cross-sectional view in FIG. 5A after insertion of the flat cable.

As shown in FIG. 5C, the forward portion of the pressure-applying portion 35 is notched, and the pressure-applying portion 35 includes a tiered portion 35*a* between the front and rear sections. As shown in FIG. 7A and FIG. 5C, when the actuator 3 is arranged in the separate position, the clearance C1 between the separated stopped portion 32 of the actuator 3 and the stopping portion 46 of the holding member 4A in the longitudinal direction is smaller than the clearance C2 between the position in front of the receiving portions 51*b* of the primary terminals 5 and the tiered portion 35*a* in the pressure-applying portion 35 of the actuator 3. Therefore, as shown in FIG. 7B and FIG. 5D, when the flat cable 9 is pulled and the actuator 3 moves forward, the stopped portion 32 of the actuator 3 comes into contact with the stopping portion 46 of the holding member 4A before the pressure-applying portion 35 of the actuator 3 comes into contact with the receiving portions 51*b* of the upper beams 51. In this way, even when the actuator 3 has moved forward, the upper beams 51 of the primary terminals 5 are not pushed upwards. As a result, the upper surface of the flat cable 9 remains pressed against the contact portions 51*a* formed in the upper beams 51. Also, even when the actuator 3 has moved forward, the stopped portion 32 of the actuator 3 comes into contact with the stopping portion 46 of the holding member 4A, and the actuator 3 is prevented from opening in the direction of the open orientation with the pressure-applying portion 35 serving as the axis.

Figure 5E:
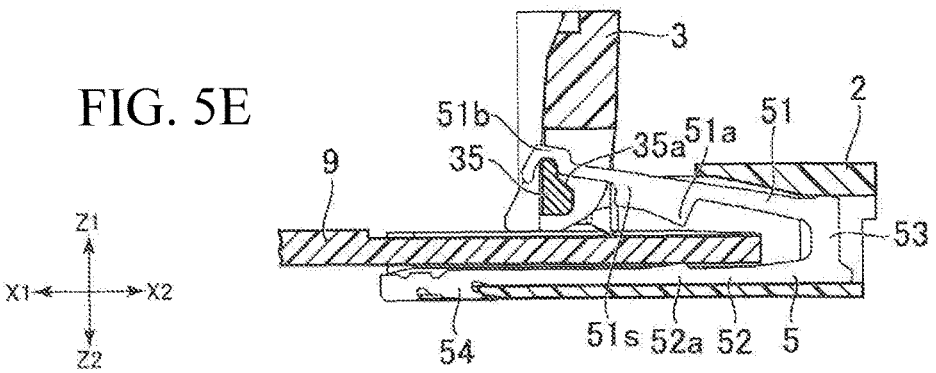
FIG. 5E is the cross-sectional view in FIG. 5A showing the positional relationship between the connector and the flat cable.
Figure 7D:
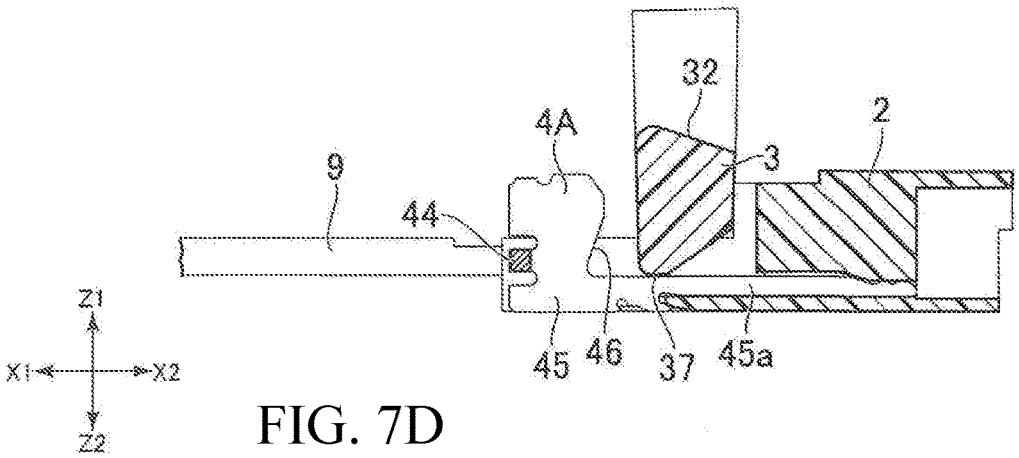
FIG. 7D is the cross-sectional view in FIG. 7A showing the actuator in the second orientation.

As shown in FIG. 5E, the actuator 3 can rotate around the pressure-applying portion 35 between the closed orientation and the open orientation. When the actuator 3 is in the open orientation, the pressure-applying portion 35 of the actuator 3 can push the receiving portions 51*b* of the upper beams 51 upwards against the elastic force of the primary terminals 5. More specifically, as shown in FIG. 8C, when the actuator 3 is in the open orientation, with the upper surface of the supporting portion 22 of the housing 2 serving as the reference, the lower surface of the supported portion 33 of the actuator 33 (contact with the rear surface of the supported portion 33 in FIG. 1) comes into contact with the upper surface. In this way, the pressure-applying portion 35 of the actuator 3 can push up the receiving portions 51*b* of the upper beams 51. Also, as shown in FIG. 4D, when the rear end surface 36 of the actuator 3 comes into contact with the upper surface of the supporting wall 23 of the housing 2, the pressure-applying portion 35 of the actuator 3 can push up the receiving portions 51*b* of the upper beams 51. Also, as shown in FIG. 7D, when the actuator 3 is in the open orientation, with the upper surfaces of the inserted portions 45*a* of the holding members 4A, 4B serving as the reference, the rear end 37 of the actuator 3 comes into contact with the upper surface, and the pressure-applying portion 35 of the actuator 3 is able to push up the receiving portions 51*b* of the upper beams 51. As a result, the interval between the contact portions 51*a* of the upper beams 51 and the contact portions 52*a* of the lower beams 52 can be widened. When the actuator 3 is in the open orientation, the contact portions 51*a* formed in the upper beams 51 move upwards away from the flat cable 9 and the contact pressure on the flat cable 9 is released.

Note that the contact portions 51*a* of the upper beams 51 may or may not come into contact with the flat cable 9. For example, when the connector has several terminals, that is, when the connector is a so-called multi-terminal connector, the pressure-applying portion 35 of the actuator 3 push up the contact portions 51*a* of the upper beams 51 with the upper surface of the supporting portion 22 of the housing 2 provided near the transverse end and the upper surface of the support wall 23 of the housing 2 or the upper surface of the inserted portions 45*a* of the holding members 4A, 4B serving as the reference. However, because the central portion of the actuator 3 in the transverse direction is bent downward, only the contact portions 51*a* of the primary terminals 5 provided in this portion can make contact with the flat cable 9. Because the upper beams 51 of the primary terminals 5 are raised when the actuator 3 is in the open orientation, the resistance of the connector can be reduced during detachment of the flat cable 9. Also, the engaging portion 31 of the actuator 3 and the notch 91 in the flat cable 9 are disengaged. When the actuator 3 is in the open orientation, the operator can easily detach the flat cable 9. The reference for the pressure-applying portion 35 pushing up the receiving portion 51*b* can be set using any position in the housing 2 or can be set using another member.

As shown in FIG. 8A through FIG. 8C, when the actuator 3 is in the open orientation, the stopped portion 33 supported by the supporting portion 22 of the housing 2 is formed in the rear of the actuator 3. Also, a pressing portion 42 and a spring portion 43 are formed in the outer plate portion 41 of the holding member 4A. Also, when the actuator 3 is in the open orientation, the pressing portion 42 is arranged on the front end of the supported portion 33. When the holding member 4A is surrounded by the actuator 3 on the upper end and the front end, the actuator 3 can be kept from rising upward and becoming detached.

Also, as shown in FIG. 8B, when a flat cable 9 is inserted with the actuator 3 in the closed orientation, the rear end of the actuator 3 is pushed up by the thickness of the flat cable 9. Here, the spring portion 43 formed in the holding member 4A biases the upper end of the supported portion 33 of the actuator 3 towards the supporting portion 22 of the housing 2. This keeps the actuator 3 from rattling when the flat cable 9 is inserted.

In this way, a flat cable 9 can be inserted into the connector 1 in the present embodiment without requiring operation of the actuator 3. Also, because the pressure-applying portion 35 formed in the actuator 3 pushes up the receiving portions 51*b* formed in the upper beams 51 of the primary terminals 5, the force acting on the flat cable 9 can be reduced. In other words, the force required to insert the flat cable 9 can be reduced.

The present disclosure is not restricted to the embodiment described above. Many variations are possible. For example, a hole can be formed in the flat cable 9 instead of a notch 91, and the engaging portion 31 formed in the actuator 3 can be fitted into the hole.

In the embodiment explained above, the holding members 4A, 4B attached to the housing 2 included stopping portions 46 for restricting forward movement of the actuator 3. However, the stopping portions 46 may be formed integrally in the housing 2. The same can be true of the pressing portions 42 and the spring portions 43 formed in the holding members 4A, 4B.

Also, the connector 1 in the present embodiment does not have to have any stopping portions 46. Even when the stopping portions 46 are eliminated, the upper beams 51 of the primary terminals 5 can be pushed up by the pressure-applying portion 35 of the actuator 3, thereby reducing the force acting on the flat cable 9.

The disclosures in the present specification are merely examples of the present disclosure. A person skilled in the art could easily make modifications while preserving the essentials of the present disclosure, and these modifications fall within the scope of the claims. The width, thickness, and shape of each component in the drawings are schematic illustrations and do not limit the interpretation of the present disclosure.

The invention claimed is:

1. A connector comprising:

a housing having an insertion passage for insertion of a flat cable from a front end;

an actuator, the actuator having a pressure-applying portion and an engaging portion, the engaging portion configured to make contact with an end portion of the flat cable and to be pushed upwards by the end portion of the flat cable as the flat cable is inserted into the insertion passage; and a plurality of primary terminals arranged inside the housing in a transverse direction, each primary terminal having an upper beam positioned above the insertion passage, each upper beam having a contact portion and a receiving portion, the contact portion being configured to make contact with the flat cable, the receiving portion being positioned in front of the contact portion and arranged above the pressure-applying portion, the receiving portion being configured to make contact with, and be pushed upward by, the pressure-applying portion when the engaging portion is pushed upward by the end portion of the flat cable, wherein the pressure-applying portion of the actuator is configured to move downward away from the receiving portion of each upper beam when the flat cable has been inserted into the insertion passage.

2. The A connector according to claim 1, wherein the receiving portion of each upper beam and the pressure-applying portion of the actuator are positioned in front of a position at which the end portion of the flat cable makes contact with the engaging portion of the actuator.

3. The connector according to claim 1, wherein the engaging portion is configured to be fitted into a hole or notch in the flat cable when the flat cable has been inserted into the insertion passage.

4. The connector according to claim 3, wherein the actuator is movable between a first orientation in which the engaging portion is positioned in a middle of the insertion passage and a second orientation in which the engaging portion stands upright relative to the housing, and wherein the pressure-applying portion of the actuator pushes the receiving portion of each upper beam upwards against an elastic force of the primary terminal when the actuator is in the second orientation.

5. The connector according to claim 1, wherein the actuator has a stopped portion positioned at least to a left or to a right of the plurality of primary terminals, and wherein the connector further comprises a stopping portion provided in front of the stopped portion of the actuator to restrict forward movement of the stopped portion.

6. The connector according to claim 1, further comprising a stopping portion, wherein the actuator has a stopped portion positioned at least to a left or to a right of the plurality of primary terminals, wherein the stopping portion is provided in front of the stopped portion of the actuator to restrict forward movement of the stopped portion, wherein the actuator is movable around the pressure-applying portion between a first orientation in which the engaging portion is positioned in a middle of the insertion passage and a second orientation in which the engaging portion is retracted upwards from the insertion passage.

7. The connector according to claim 6, wherein the stopped portion of the actuator comes into contact with the stopping portion before the pressure-applying portion of the actuator comes into contact with the receiving portion of each upper beam when the actuator is moving forward.

8. The connector according to claim 1, wherein each of the plurality of primary terminals has a lower beam positioned below the insertion passage, and each upper beam and each lower beam are configured to clamp the flat cable using elastic force of the primary terminals.

9. The connector according to claim 1, further comprising a plurality of secondary terminals arranged in alternating fashion with the plurality of primary terminals.

10. A connector comprising:

a housing having an insertion passage for insertion of a flat cable from a front end;

an actuator, the actuator having a pressure-applying portion and an engaging portion, the engaging portion configured to make contact with an end portion of the flat cable and to be pushed upwards by the end portion of the flat cable as the flat cable is inserted into the insertion passage;

a plurality of primary terminals arranged inside the housing in a transverse direction, each primary terminal having an upper beam positioned above the insertion passage, each upper beam having a contact portion and a receiving portion, the contact portion being configured to make contact with the flat cable, the receiving portion being positioned in front of the contact portion and arranged above the pressure-applying portion, the receiving portion being configured to make contact with, and be pushed upward by, the pressure-applying portion when the engaging portion is pushed upward by the end portion of the flat cable; and a stopping portion, wherein the actuator has a stopped portion positioned at least to a left or to a right of the plurality of primary terminals, wherein the stopping portion is provided in front of the stopped portion of the actuator to restrict forward movement of the stopped portion, wherein the actuator is movable around the pressure-applying portion between a first orientation in which the engaging portion is positioned in a middle of the insertion passage and a second orientation in which the engaging portion is retracted upwards from the insertion passage, wherein the actuator in the first orientation is configured to move in a longitudinal direction between a first position in which the stopped portion of the actuator comes into contact with the stopping portion and a second position in which the stopped portion of the actuator moves away from the stopping portion to a rear allowing rotation from the first orientation to the second orientation.

11. The connector according to claim 8, wherein the stopped portion of the actuator comes into contact with the stopping portion before the pressure-applying portion of the actuator comes into contact with the receiving portion of each upper beam when the actuator is moving forward.

12. A connector comprising:

a housing having an insertion passage for insertion of a flat cable from a front end;

an actuator, the actuator having a pressure-applying portion, a supported portion and an engaging portion, the engaging portion configured to make contact with an end portion of the flat cable and to be pushed upwards by the end portion of the flat cable as the flat cable is inserted into the insertion passage;

a plurality of primary terminals arranged inside the housing in a transverse direction, each primary terminal having an upper beam positioned above the insertion passage, each upper beam having a contact portion and a receiving portion, the contact portion being configured to make contact with the flat cable, the receiving portion being positioned in front of the contact portion and arranged above the pressure-applying portion, the receiving portion being configured to make contact with, and be pushed upward by, the pressure-applying portion when the engaging portion is pushed upward by the end portion of the flat cable;

a supporting portion positioned below the supported portion of the actuator for supporting the supported portion; and a spring portion for biasing the supported portion of the actuator toward the supporting portion while the flat cable is being inserted into the insertion passage, wherein the supported portion is positioned at least to a left or to a right of the plurality of primary terminals.

13. The connector according to claim 12, wherein the actuator has a stopped portion positioned at least to a left or to a right of the plurality of primary terminals, and wherein the connector further comprises a stopping portion provided in front of the stopped portion of the actuator to restrict forward movement of the stopped portion.

14. The connector according to claim 12, wherein each of the plurality of primary terminals has a lower beam positioned below the insertion passage, and each upper beam and each lower beam are configured to clamp the flat cable using elastic force of the primary terminals.

15. The connector according to claim 12, further comprising a plurality of secondary terminals arranged in alternating fashion with the plurality of primary terminals.

* * * * *